United States Patent [19]

von Wichert et al.

[11] 4,279,609

[45] Jul. 21, 1981

[54] METHOD AND APPARATUS FOR MAKING COLLAPSIBLE CONTAINERS

[75] Inventors: Nils von Wichert, Glinde; Dieter Schwenke, Hamburg, both of Fed. Rep. of Germany

[73] Assignee: Hauni-Werke Körber & Co. KG, Hamburg, Fed. Rep. of Germany

[21] Appl. No.: 111,263

[22] Filed: Jan. 11, 1980

[30] Foreign Application Priority Data

Jan. 17, 1979 [DE] Fed. Rep. of Germany ..... 2901571

[51] Int. Cl.[3] ..... B31B 1/26; B31B 1/80

[52] U.S. Cl. ..... 493/276; 493/294; 493/302; 493/316; 493/125; 493/180

[58] Field of Search ..... 493/295, 302, 127, 125, 493/178–180, 316, 313, 309, 276; 93/52, 49, 82, 77, 94, 36

[56] References Cited

U.S. PATENT DOCUMENTS

| | | | |
|---|---|---|---|
| 1,123,445 | 1/1915 | Staude | 493/178 X |
| 2,029,394 | 2/1936 | Sidebotham | 493/295 X |
| 3,391,618 | 7/1968 | Clem | 493/302 X |
| 3,439,588 | 4/1969 | Taylor et al. | 493/295 |
| 3,803,992 | 4/1974 | Verwey | 493/295 X |

*Primary Examiner*—James F. Coan
*Attorney, Agent, or Firm*—Peter K. Kontler

[57] ABSTRACT

Blanks which are made of cardboard or the like and wherein the neighboring panels are flexible relative to each other are converted first into flat tubular preforms which are thereupon expanded prior to a change of orientation and introduction into a filling machine. The conversion is carried out on a horizontal support during stepwise transport of successive blanks along a stationary elongated one-piece flat pattern having progressively narrower portions at several successive deforming stations. At the first deforming station, a lap which is integral with one outermost panel of each blank is flexed relative to the respective outermost panel; at the second deforming station, the lap and the respective outermost panel are folded over the adjacent portion of the pattern; and the other outermost panel is bonded to the lap at the third deforming station. The width of the pattern at the first deforming station equals the combined width of three neighboring panels, and the width of the pattern at the second and third deforming stations equals the combined width of two neighboring panels. The thus obtained flat tubular preforms are expanded at an additional station where the width of the pattern equals the width of a single panel.

11 Claims, 8 Drawing Figures

METHOD AND APPARATUS FOR MAKING COLLAPSIBLE CONTAINERS

BACKGROUND OF THE INVENTION

The present invention relates to a method and apparatus for making containers, especially for making boxes or packs which consist of carboard or the like. More particularly, the invention relates to improvements in a method and apparatus for making collapsible boxes or analogous containers which can be erected by deforming flat tubular preforms so as to convert the preforms into tubes having a polygonal (normally square or rectangular) cross-sectional outline. Still more particularly, the invention relates to improvements in a method and apparatus for converting blanks which consist of cardboard or another suitable sheet material into flat tubes by resorting to a transporting system which advances successive blanks along stationary guide means with mutually staggered folding edges and by deforming selected portions or panels of successive blanks so that the deformed panels overlie certain parts of the guide means.

German Pat. No. 598,819 discloses an apparatus which is designed to form flat tubular preforms for the manufacture of boxes, packs or other types of containers. The operation is continuous and involves the conversion of successive blanks into tubular preforms. The blanks are transported by endless conveyor belts along a plurality of discrete stationary guide rails and are engaged by stationary wire yokes or similar folding elements which cause successive blanks to assume the shape of flat tubes, i.e., the blanks are converted into preforms which can be erected to constitute containers having a polygonal cross-sectional outline. The preforms are introduced into and stacked in a magazine. The apparatus which is disclosed in the aforesaid German patent renders it possible to turn out large quantities of preforms per unit of time. However, the seams where the marginal portions of neighboring walls or panels of the preforms are bonded to each other are not always uniform, i.e., it happens again and again that the absence of predictable overlapping of neighboring panels or laps which adhere to certain panels results in the making of containers whose configuration deviates from the desired optimum shape. Moreover, the numerous guide rails which are used in the patented apparatus and around which portions of the blanks are folded to convert such blanks into preforms cannot be mounted in such a way as to ensure highly accurate guidance of moving blanks. This is due to the fact that only one side or end of each guide rail can be mounted in cantilever fashion.

OBJECTS AND SUMMARY OF THE INVENTION

An object of the invention is to provide a novel and improved method of converting blanks into preforms and containers in a simple, time-saving and reliable manner and in such a way that the configuration of each of a long series of successively formed containers matches the desired or optimum configuration.

Another object of the invention is to provide a method of the just outlined character which can be resorted to for the manufacture of a wide variety of containers and which can be practiced by resorting to a relatively simple, compact and inexpensive apparatus.

A further object of the invention is to provide an apparatus which can be used for the practice of the above outlined method and can be rapidly converted for the making of different sizes and/or shapes of containers.

Another object of the invention is to provide the apparatus with novel and improved means for facilitating the conversion of blanks into flat tubular preforms and for facilitating the conversion of preforms into erected tubular preforms or finished containers which are ready for transfer to a filling station or to another processing station.

An additional object of the invention is to provide the apparatus with novel and improved transporting means for advancing the blanks and preforms along a predetermined path.

A further object of the invention is to provide the apparatus with novel and improved guide means for blanks and with novel and improved means for folding selected portions or panels of blanks at selected stations of the apparatus.

An ancillary object of the invention is to provide the apparatus with novel and improved means for removing blanks from a magazine and with novel and improved means for converting collapsed containers (flat tubular preforms) into erected or expanded containers.

One feature of the invention resides in the provision of a method of converting foldable blanks (e.g., blanks made of lightweight cardboard) of the type having a plurality of neighboring panels including two outermost panels into tubular containers. The method comprises the steps of transporting the blanks seriatim along a predetermined path through a plurality of successive stations which include a row of deforming or folding stations and an additional station and are defined by progressively narrower portions of a substantially flat one-piece guide or pattern (e.g., an elongated plate made of sheet metal, having a thickness of approximately one millimeter and being supported at one end in cantilever fashion), converting successive blanks into flat tubular preforms including folding selected panels of consecutive blanks about the adjacent portions of the pattern and connecting the outermost panels of consecutive blanks for articulate movement relative to each other at the various deforming stations, and expanding the flat preforms at the additional station. The thus expanded preforms are thereupon caused to change their orientation (if necessary), e.g., by moving them from a substantially horizontal path into a path wherein one open end of each expanded preform is located at a level above the other open end, and such preforms are then ready to be converted into containers, e.g., by closing their lower ends, prior to admission of containers into a filling station where the containers receive predetermined quantities of flowable, particulate or other material, e.g., stacks of biscuits or the like.

The aforementioned transporting step preferably includes advancing the blanks stepwise from station to station and temporarily holding the blanks against movement along the predetermined path at each deforming station. If desired or necessary, the preforms can be temporarily arrested at the additional station, i.e., during expansion of flat tube-like preforms into preforms having two open ends and a polygonal (e.g., square or rectangular) cross-sectional outline.

One outermost panel of each blank is or may be provided with a flexible lap which is flexed at the first deforming station and one side of which is coated with a suitable adhesive (e.g., hotmelt) ahead of the station (normally the last deforming station) at which the two outermost panels of consecutive blanks are connected to each other. The connecting step then includes bonding the other outermost panel of each blank to the adhesive-coated side of the respective lap.

The first deforming or folding station can be preceded by a station at which a magazine stores a stack of blanks and at which a suitable withdrawing mechanism removes successive blanks from the magazine and transfers the removed blanks into the aforementioned predetermined path at the first deforming station or at a station which precedes the first deforming station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
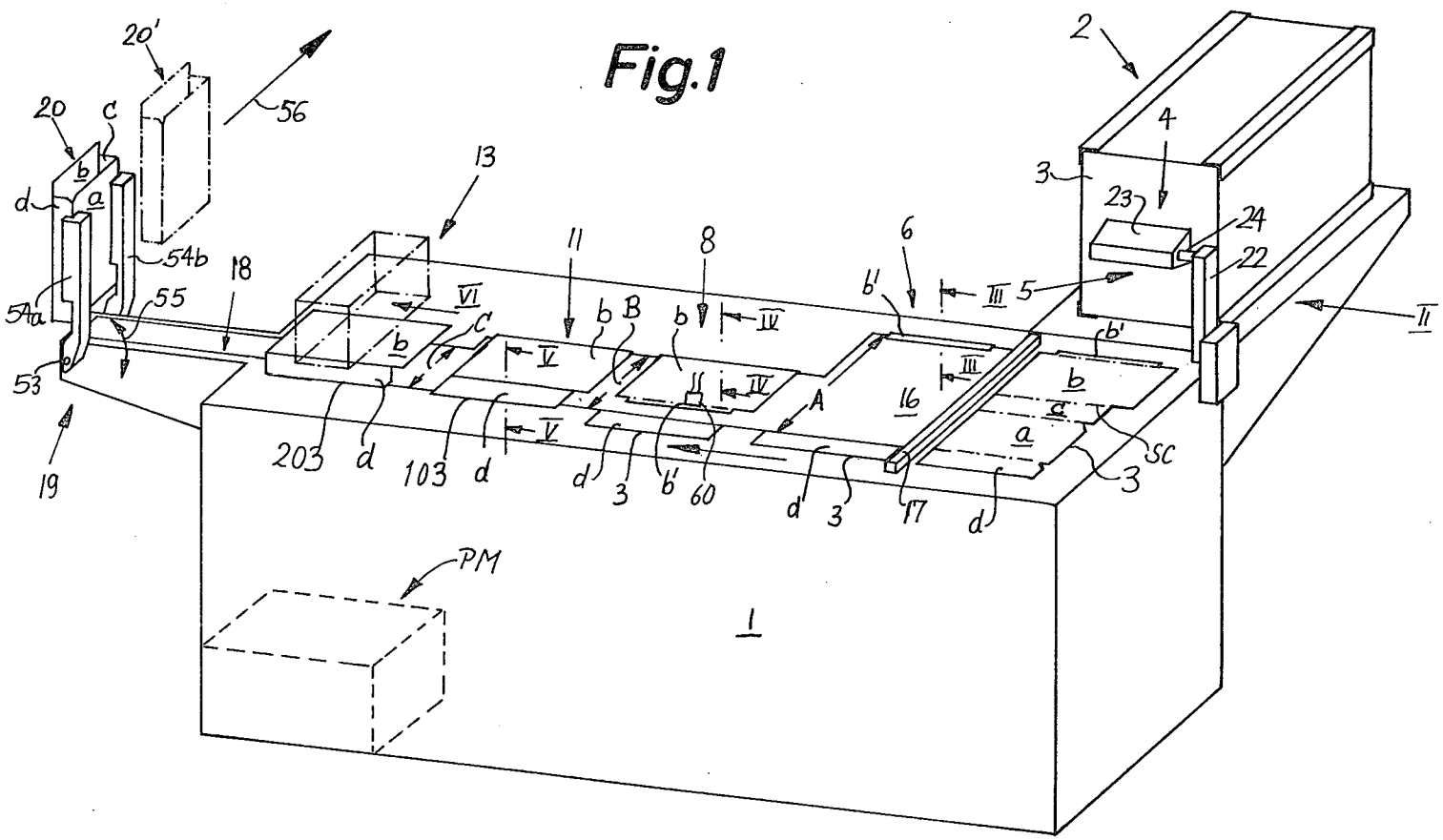
FIG. 1 is a schematic perspective view of an apparatus which embodies the invention.

Referring first to FIG. 1, there is shown an apparatus which converts flat blanks 3 into expanded preforms 203 constituting open-ended containers. The apparatus comprises a main support or frame 1 for a plurality of folding and other tools which are disposed at several stations. The apparatus which is shown in FIG. 1 can constitute one component of a complete production line serving to process the preforms 203 so as to convert each preform into a pack or box which is open at the top and to introduce into each box a predetermined quantity of flowable, particulate or other material, e.g., a stack of biscuits. The filled boxes are thereupon closed at the top and can be transported to a further locale for wrapping, sealing and/or other treatment.

Figure 2:
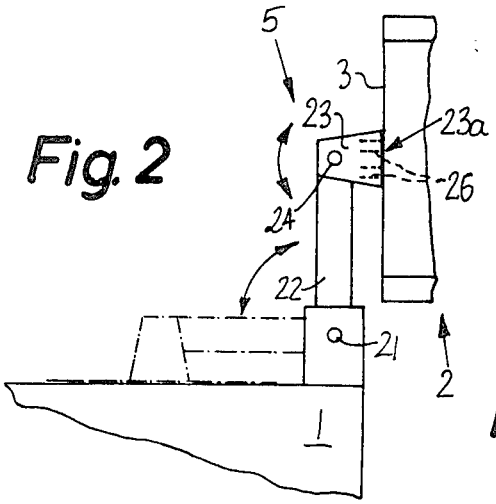
FIG. 2 is an enlarged side elevational view of the mechanism which transfers blanks from a magazine into the path along which the blanks are transported during conversion into flat tubular preforms, the view of FIG. 2 being taken in the direction of arrow II shown in FIG. 1'
Figure 3:
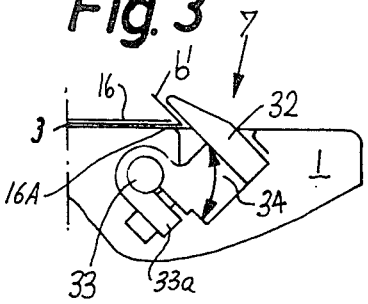
FIG. 3 is a schematic transverse vertical sectional view as seen in the direction of arrows from the line III—III of FIG. 1 and illustrates a first folding tool which serves to move elongated marginal laps of successive blanks out of the general planes of the respective blanks at a first folding or deforming station.

The apparatus which is shown in the drawing comprises a station which includes a magazine 2 for a supply of stacked blanks 3. Each such blank may consist of cardboard and is scored, as at SC (indicated by phantom lines), so as to facilitate the folding of neighboring walls or panels and laps with respect to each other. The station including the magazine 2 is followed by a withdrawing station 4 which accommodates instrumentalities for removal of discrete blanks 3 from the magazine 2 and for deposition of such blanks onto the frame or support 1 ahead of an elongated stepped one-piece guide or pattern 16. The withdrawing instrumentalities are denoted by the reference character 5 and certain details thereof are illustrated in FIG. 2. Such withdrawing instrumentalities place successive blanks 3 (each such blank is a flat sheet consisting of cardboard or the like) into a first portion of an elongated path along which the blanks 3 advance into the range of a first folding or deforming tool 7 certain details of which are shown in FIG. 3 and which serves to flex an elongated lap b' adjacent to one side of a relatively wide outermost wall or panel b of the respective blank 3. Such folding takes place at a first folding or deforming station 6. Each blank 3 comprises a total of four neighboring walls or panels a, b, c and d as well as the aforementioned lap b' which must be coated with adhesive prior to bonding to the free marginal portion of the other outermost panel d. This results in conversion of a blank 3 into a flat tubular preform 103 which is thereupon expanded to form an expanded preform 203, and such expanded preform is thereupon erected so that one of its open ends is located at a level above the other open end.

Figure 4:
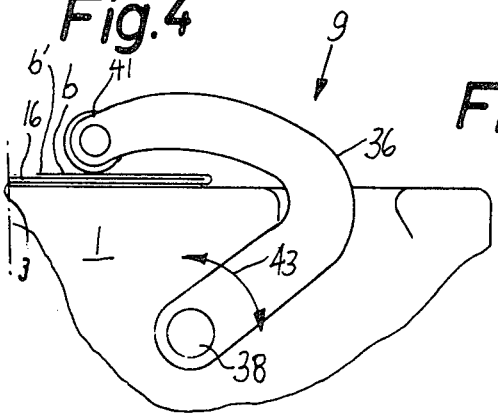
FIG. 4 is a schematic transverse vertical sectional view as seen in the direction of arrows from the line IV—IV of FIG. 1 and shows a folding tool at a second folding or deforming station of the improved apparatus.

The first deforming station 6 is followed by a second folding or deforming station 8 which accommodates a folding tool 9 the details of which are illustrated in FIG. 4. The purpose of the tool 9 is to fold the lap b' and the panel b over the panels a and c of the respective blank 3.

Figure 5:
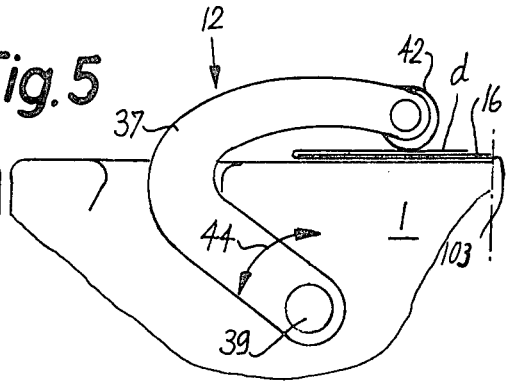
FIG. 5 is a schematic transverse vertical sectional view as seen in the direction of arrows from the line V—V of FIG. 1 and shows a third folding tool which is a mirror image of the tool shown in FIG. 4 and is installed at a third folding or deforming station.

The second deforming station 8 is followed by a third folding or deforming station 11 with a folding tool 12 which is mounted in the frame 1 and certain details of which are shown in FIG. 5. The purpose of the tool 12 is to fold the outermost panel d over a portion of the panel a (the panels a and b are wider than the panels c and d) and to connect (bond) the marginal portion of the panel d to the adhesive-coated lap b'. This completes the conversion of the blank 3 into a flat tubular preform 103.

Figure 6:
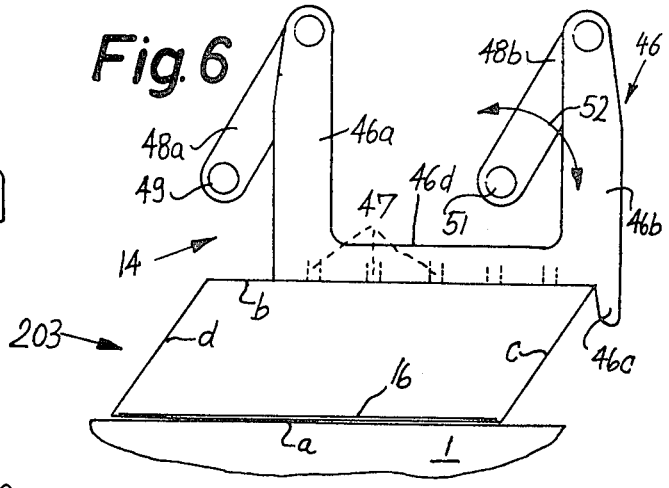
FIG. 6 is a schematic view as seen in the direction of arrow VI in FIG. 1 and illustrates the mechanism for conversion of flat tubular preforms into expanded tubular preforms at an additional station.

The folding station 11 is followed by an additional or expanding station 13 accommodating instrumentalities 14 which are shown in FIG. 6 and serve to expand the preforms 103 so that each such preform yields an expanded hollow tubular preform 203 having a rectangular cross-sectional outline.

The pattern 16 is a one-piece plate made of sheet metal or the like and is mounted on a carrier 17 in cantilever fashion so that a blank 3 which is engaged by a transporting means or conveyor 18 can be advanced between the end portions of the carrier 17 by sliding along the upper side of the support 1 in order to assume a requisite position at the first deforming station 6, namely, a position in which the blank 3 is located between the upper side of the support 1 and the underside of the widest portion A of the pattern 16. The width of the portion A equals the combined width of three neighboring panels (a, b, c) of the blank 3 at the deforming station 6. The width B of the pattern 16 at the neighboring second and third deforming stations 8 and 11 equals the combined width of two neighboring panels (a, c or b, d), and the width C of the pattern 16 at the additional station 13 equals the width of a single panel (a or b) of a flat tubular preform 103.

Figure 8:
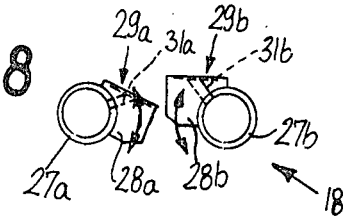
FIG. 8 is an end elevational view of the conveyor.
Figure 7:
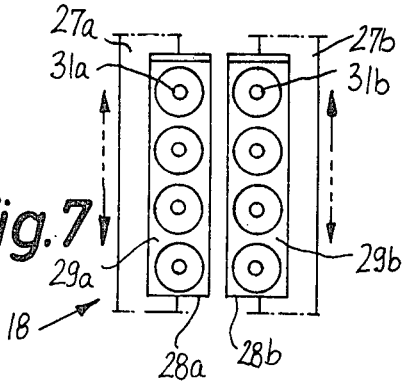
FIG. 7 is a fragmentary plan view of the transporting means or conveyor which serves for stepwise transport of blanks and preforms in the apparatus of FIG. 1.

The conveyor 18 is installed in the support 1 at a level below the plane of the pattern 16. The exact construction of this conveyor is shown in FIGS. 7 and 8. The conveyor 18 is effective in the region between the station 4 and all the way to a take-off conveyor 19 for expanded preforms 203, namely, for nearly finished containers each of which has two open ends and is ready to be advanced to the filling station, not shown.

The witdrawing instrumentalities 5 at the station 4 include a horizontal shaft 21 for a lever 22 which carries a pivot member 24 for a turnable suction head 23. The axis of the pivot member 23 is parallel to the axis of the shaft 21 and is parallel to the longitudinal direction of the pattern 16, i.e., to the direction of advancement of consecutive blanks 3 under the action of the conveyor 18. The suction head 23 has a blank-attracting surface 23*a* which is formed with suction ports 26. The suction ports 26 are connected to the intake of a suitable suction generating device (e.g., a fan, not shown) during transport of the suction head 23 from the solid-line to the phantom-line position of FIG. 2, i.e., while the suction head 23 transfers the outermost blanks 3 of the stack of blanks in the magazine 2 onto the support 1 (and more particularly onto the rearmost portion of the conveyor 18 behind the first deforming station 6). The means for rotating the suction head 23 clockwise about the axis of the pivot member 24 while the lever 22 turns counterclockwise about the axis of the shaft 21, as viewed in FIG. 2, in order to transfer a fresh blank 3 from the magazine 2 onto the conveyor 18 is installed in the interior of the support 1 and in or on the lever 22, and the exact details of such means form no part of the present invention. The transmission ratio between the pivotal movements of the suction head 23 and lever 22 is two-to-one. An advantage of the just described withdrawing mechanism 5 is that the blanks 3 are singularized in a fully automatic way and are transported from the magazine 2 onto the conveyor 18 along the shortest path possible. The support 1 confines or is adjacent to a suitable prime mover PM which rotates the shaft 21 counterclockwise and thereupon clockwise, always through approximately 90 degrees, during each interval of idleness of the conveyor 18 which is operated in stepwise fashion and receives motion from the prime mover PM, e.g., through the medium of a Geneva mechanism or the like, not shown.

The conveyor 18 comprises two elongated tubular conveying elements 27*a* and 27*b* (see particularly FIGS. 7 and 8) which are parallel to the longitudinal direction of the pattern 16 and are movable in opposite directions, in and counter to the direction of advancement of blanks 3 from station to station. Thus, the tubular conveying element 27*a* moves rearwardly (in a direction to the right, as viewed in FIG. 1) while the conveying element 27*b* moves forwardly, and vice versa. The conveying element 27*a* or 27*b* engages and transports a series of flat or partially deformed blanks 3 as well as the preforms 103, 203 while moving forwardly but such element is disengaged from the blanks and preforms during movement in the rearward direction.

The tubular conveying elements 27*a*, 27*b* are movable lengthwise and are further turnable about their respective longitudinal axes. Each of these conveying elements carries a series of suitably spaced suction pockets which are respectively denoted by the reference characters 28*a*, 28*b* and respectively comprise blank-attracting or panel-attracting surfaces 29*a*, 29*b* provided with suction ports 31*a*, 31*b*, respectively. The length of each of the conveying elements 27*a*, 27*b* equals the combined length of four out of five stations 4, 6, 8, 11 and 13. The length of forward or return strokes of the elements 27*a*, 27*b* equals the distance between the centers of two neighboring stations. The distance between the centers of each pair of neighboring stations (e.g., 6, 8 or 8, 11 or 11, 13) is the same. The means for reciprocating the elements 27*a*, 27*b* in and counter to the direction of transport of the blanks 3 on the support 1 and for changing the angular positions of such conveying elements at required intervals is installed in the support 1 and preferably receives motion from the prime mover PM. The exact details of such means form no part of the present invention.

The folding or deforming tool 7 at the first deforming station 6 comprises a shaft 33 which is mounted in the support 1 below the station 6 and carries a holder 33*a* for a folding element 32. The double-headed arrow 34 denotes the directions of clockwise and counterclockwise angular movement of the holder 33*a* during predetermined stages of operation of the improved apparatus, namely, whenever a blank 3 has arrived at the deforming station 6 and is at a standstill so that its lap b′ can be flexed by the element 32 over the adjacent edge face 16A of the pattern 16 in the region where the width A of the pattern 16 equals the combined width of three neighboring panels a, b and c. The holder 33*a* is separably screwed or otherwise secured to and shares the angular movements of the shaft 33 which receives motion from the prime mover PM. The arrangement is such that the shaft 33 is turned counterclockwise and thereupon clockwise during each interval of idelness of the conveyor 18, i.e., while a blank 3 is at a standstill at the first deforming station 6. The purpose of the element 32 is to flex the lap b′ but not to such an extent that the lap b′ would not return into or close to the plane of the respective outermost panel b. In other words, when the element 32 is pivoted clockwise from the position which is shown in FIG. 3, the lap b′ returns or can return (at least in part) to the original position of coplanarity with the adjacent outermost panel b of the respective blank 3.

The folding tools 9 and 12 at the second and third deforming stations 8 and 11 are of identical design and are mirror symmetrical to each other with reference to a vertical plane which is disposed between the conveying elements 27*a* and 27*b*. As shown in FIG. 4, the tool 9 comprises a horizontal shaft 38 which is journalled in the support 1 and carries an arcuate arm 36 serving as a carrier for a folding roll 41. The prime mover PM turns the shaft 38 in directions indicated by the double-headed arrow 43 during each interval of idleness of the conveyor 18 and while a blank 3 is located at the second deforming station 8. The roll 41 folds the panel b and its lap b′ over the portion B of the pattern 16 while the shaft 38 turns in a counterclockwise direction, as viewed in FIG. 4.

The tool 12 at the third or last deforming station 11 comprises a horizontal shaft 39 which is journalled in the support 1 and is rigidly connected with an arcuate arm 37 which carries a folding roll 42 serving to fold the panel d of a blank 3 at the station 11 over the portion B of the pattern 16 as well as over the lap b'. At such time, the upper side of the lap b' is coated with a suitable adhesive (e.g., a hotmelt) which issues from a nozzle 60 shown in FIG. 1. The directions in which the shaft 39 is caused to turn during each interval of idleness of the conveyor 18 (and more particularly, during each interval of dwell of a partially deformed blank 3 at the station 11) are indicated by a double-headed arrow 44 shown in FIG. 5. When the shaft 39 completes its pivotal movement in a clockwise direction, as viewed in FIG. 5, the blank 3 at the station 11 is converted into a flat tubular preform 103 wherein the two outermost panels b, d are articulately connected to each other by the respective lap b' and wherein the panels a, c are located at a level below whereas the panels b, d are located at a level above the portion B of the pattern 16.

The expanding instrumentalities 14 at the additional station 13 comprise the component parts which are shown in FIG. 6. Such parts include an inverted U-shaped suction head 46 having a web **46*d* provided with suction ports 47 and two legs 46*a*, 46*b* which are respectively connected to links 48*a*, 48*b*. The links 48*a*, 48*b* are respectively mounted on shafts 49, 51. The link 48*a* can rotate on or with the shaft 49 which is not driven, and the link 48*b* is rigid with the shaft 51 which is driven by the prime mover PM during the intervals of ineffectiveness of the conveyor 18, i.e., when a flat tubular preform 103 is located at the additional station 13. The effective length of the link 48*a* is the same as that of the link 48*b*. The directions in which the shaft 51 is turned during each interval of ineffectiveness of the conveyor 18 are indicated by a double-headed arrow 52. In FIG. 6, the reference character 46*c* denotes a projection at the junction of the leg 46*b* and web 46*d*; the purpose of this projection is to assist the expanding action of the suction head 46. Such expanding action takes place when the shaft 51 is rotated in a counterclockwise direction, as viewed in FIG. 6, and the suction ports 47 communicate with the intake of a suction generating device. This causes the web 46*d* to attract the panel b of the preform 103 at the station 11 and to move the panel b above and away from the portion C of the pattern 16. Consequently, the originally flat preform 103 is converted into a preform 203** having a rectangular cross-sectional outline and two open ends.

The take-off conveyor 19 comprises two arms **54*a*, 54*b* which are secured to a horizontal shaft 53 and are pivotable in directions indicated by a double-headed arrow 55 shown in FIG. 1. The arms 54*a*, 54*b* can be pivoted between horizontal positions adjacent to the left-hand end of the conveyor 18 and substantially vertical positions which are shown in FIG. 1. When the conveyor 18 delivers an expanded preform 203 onto the arms 54*a*, 54*b* while such arms assume the horizontal positions and are adjacent to the left-hand end portions of the conveying elements 27*a*, 27*b*, and the arms 54*a*, 54*b* are thereupon caused to move to the illustrated positions, the preform 203 is erected (i.e., its orientation is changed) so that the resulting container 20 has an open upper end and an open lower end. Such containers are thereupon transported in the direction indicated by arrow 56, for example, to the aforementioned filling station which is not shown in the drawing. The means for advancing the containers 20 in the direction of arrow 56 includes a further conveyor of any suitable design which is not specifically shown in FIG. 1. The container 20' which is denoted in FIG. 1** by phantom lines is assumed to be carried by the aforementioned further conveyor.

The operation of the improved apparatus will be readily understood upon perusal of the preceding part of the description. Therefore, the following passage will merely point out certain steps of the method of converting flat blanks 3 into containers 20 by resorting to the apparatus which is shown in FIGS. 1 to 8.

The withdrawing instrumentalities 5 at the station 4 remove blanks 3 from the magazine 2 at intervals whose duration depends on the selected speed of the conveyor 18. The withdrawn blanks 3 are deposited on the rearmost portion of the conveyor 18 (to the right of the carrier 17, as viewed in FIG. 1) which transports such blanks from station to station, in stepwise fashion and at intervals which are sufficiently long to allow for proper treatment of blanks and preforms at the various stations. As mentioned above, the discharge end of the conveyor 18 is sufficiently close to the take-off conveyor 19 to enable the arms **54*a*, 54*b* (which are also provided with suction ports, not specifically shown) to accept successive expanded preforms 203 for delivery into the range of the further conveyor which advances the containers 20 in the direction of the arrow 56**.

A first conveying step is carried out as follows: The tubular conveying element **27*a* is held in the angular position of FIG. 8 and the suction ports 31*a* in the surfaces 29*a* of its pockets 28*a* are disconnected from the associated suction generating device. Therefore, the conveying element 27*a* cannot attract any blanks and/or preforms and is ready to move rearwardly. At the same time, the suction ports 31*b* in the surfaces 29*b* of pockets 28*b* on the conveying element 27*b* are connected to the suction generating device and the surfaces 29*b* attract the blanks 3 and preforms 103, 203 while the conveying element 27*b* moves forwardly through a distance matching that between the centers of two neighboring stations. Thus, the conveying element 27*b* advances several blanks 3, a preform 103 and a preform 203 by a step prior to disconnection of its suction ports 31*b* from the associated suction generating device. The conveying element 27*b* is then turned so that its pockets 28*b* descend to a level below the path for the blanks 3 and preforms 102, 203 on the support 1 and begins to move rearwardly. At the same time, the conveying element 27*a* (which has reached its rear end position) is caused to turn counterclockwise, as viewed in FIG. 8, so that the surfaces 29*a* of its pockets 28*a* are adjacent to the blanks and preforms at the respective stations, 4, 6, 8, 11 and 13, and the suction ports 31*a* are connected with the suction generating device before the conveying element 27*a* begins to move forwardly, again through a distance matching that between the centers of two neighboring stations. This results in advancement of a fresh blank from the space behind the carrier 17 to the station 6, of another blank from the station 6 to the station 8, of a further blank from the station 8 to the station 11, of a preform 103 from the station 11 to the station 13, and of a preform 203 from the station 13 into the range of the arms 54*a*, 54*b* of the take-off conveyor 19. The just described mode of operation of the conveyor 18 is repeated again and again, i.e., the elements 27*a* and 27*b* alternate in transporting blanks and preforms in a predetermined direction, namely, from the location behind the carrier 17 toward and into the range of the take-off conveyor 19**.

At the first deforming station 6, the element 32 folds the lap b′ so as to ensure that the preform 103 can be readily expanded after the panel d is caused to adhere to the adhesive-coated side of the lap b′. The scoring SC of blanks 3 which are stored in the magazine 2 is often desirable but is not absolutely necessary, i.e., a scoring line between the panel b and the lap b′ can be formed, for the first time, when the lap b′ is located at the station 6 and is folded by the element 32. Such scoring line is obtained as a result of folding of the lap b′ around the adjacent edge 16A of the portion A of the pattern 16.

The roll 41 of the folding tool 9 at the station 8 folds the panel b and its lap b′ over the portion B of the pattern 16, and the roll 42 of the tool 12 at the station 11 folds the panel d over the lap b′ after the outer side of the lap b′ has been coated with adhesive which is supplied by the nozzle 60. The instrumentalities 14 at the station 13 expand the preforms 103 to convert such preforms into hollow tubular preforms 203 before the preforms 203 reach the arms 54*a*, 54*b* of the take-off conveyor 19. During expansion of flat tubular preforms 103, the projection 46*c* of the suction head 46 ensures that the panel b of a preform 103 cannot be shifted with respect to the suction head 46. The preforms 203 are thereupon reoriented (erected) by the arms 54*a*, 54*b* prior to transfer into the range of the further conveyor which advances the containers 20 in the direction of the arrow 56.

An important advantage of the improved method and apparatus is that all of the containers 20 are of identical size and shape. This is attributable, at least in part, to the provision of the pattern 16 which can be readily held in a predetermined position to thus ensure that the manner in which a preceding blank 3 is converted into a preform 203 is identical with the manner of conversion of each following blank. The edges flanking the portions B and C of the pattern 16 are parallel to each other so as to guarantee that the score lines (if formed during dwell of the blanks at the stations 6, 8, 11 and 13) are accurately defined and can be relied upon for the making of containers 20 whose dimensions match the desired optimum dimensions. If the containers 20 have a rectangular or square cross-sectional outline, the edge faces of the pattern 16 in the regions of its portions A, B and C ensure that the panels a and c are respectively parallel to the panels b and d in each and every container 20 which reaches the filling or another processing station. In the absence of scoring prior to insertion of blanks 3 into the magazine 2, expansion of the preforms 103 at the additional station 13 results in the formation of accurately defined score lines between the panels a and c of each and every container 20.

It is clear that the containers 20 can be collapsed and stored in a magazine or elsewhere prior to transport to the next processing station. Such renewed collapsing of containers 20 does not affect their shape because the score lines are there and can be resorted to again and again in order to convert preforms 103 into preforms 203 or containers 20.

Another advantage of the improved method and apparatus is that the combined length of the various stations above the support 1 is not excessive. This is desirable and advantageous in order to ensure that the relatively thin pattern 16 will retain its optimum position which is necessary in order to guarantee that the shape of each and every container 20 will match a desired or optimum shape. It will be readily appreciated that the stability of the pattern 16 is increased if the length of such pattern is reduced to a minimum. The provision of a stepwise operated conveyor for blanks and preforms also contributes to the possibility of using a relatively short pattern.

The provision of a pneumatic conveyor for transport of blanks 3 and preforms 103, 203 along the pattern 16 is advisable and advantageous because such conveyor prevents changes in orientation of blanks and preforms relative to the preform 16 while the blanks and preforms are in motion.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a method of converting foldable blanks of the type having a plurality of neighboring panels including two outermost panels into tubular containers, the steps of transporting the blanks seriatim along a predetermined path through a plurality of successive stations which include a row of deforming stations and an additional station and are defined by progressively narrower portions of a substantially flat one-piece pattern; converting consecutive blanks into flat tubular preforms including folding selected panels of consecutive blanks about the adjacent portions of the pattern and connecting the outermost panels of consecutive blanks for articulate movement relative to each other at said deforming stations; and expanding the flat preforms at said additional station.

2. The steps of claim 1, wherein said transporting step includes advancing the blanks stepwise from station to station and temporarily holding the blanks against movement along said path at each of said deforming stations.

3. The steps of claim 1, wherein one of the outermost panels of each blank has a flexible lap and said converting step includes flexing said lap at the first deforming station, as considered in the direction of transport of blanks along said path.

4. The steps of claim 3, further comprising the step of applying adhesive to one side of the lap of each blank intermediate said first deforming station and the deforming station immediately preceding said additional station, said connecting step including bonding the other outermost panel to the adhesive-coated lap of the respective blank.

5. In an apparatus for converting foldable blanks of the type having a plurality of neighboring panels including two outermost panels into tubular containers, the combination of a support; an elongated flat one-piece pattern mounted in said support and having a plurality of progressively narrower portions, said pattern defining a row of successive deforming stations including a first and a last deforming station and an additional station; means for transporting consecutive blanks through said stations in a predetermined direction first through said first deforming station and last through said additional station; folding tools provided at said deforming stations and operative to convert successive blanks into flat tubular preforms by folding selected panels of consecutive blanks over said pattern and connecting the two outermost panels of consecutive blanks for articulate movement relative to each other; and means for expanding successive flat preforms at said additional station.

6. The combination of claim 5 for converting foldable blanks of the type having four neighboring panels, wherein a first portion of said pattern has a width which at least approximates the combined width of three neighboring panels of a blank and a second portion of said pattern has a width which at least approximates the combined width of two neighboring panels of a blank, said second portion of said pattern being located downstream of said first portion, as considered in said predetermined direction.

7. The combination of claim 6, wherein said pattern has a third portion which is disposed at said additional station and whose width at least approximates the width of a single panel.

8. The combination of claim 5, wherein said transporting means comprises a conveyor which advances the blanks stepwise from station to station.

9. The combination of claim 5, wherein said pattern has portions of identical width at two successive stations, as considered in said predetermined direction.

10. The combination of claim 5, wherein said transporting means includes a pneumatic conveyor having blank-attracting surfaces provided with suction ports.

11. The combination of claim 10, wherein said conveyor includes two conveying elements extending lengthwise of said pattern, as considered in said predetermined direction, and being movable in opposite directions in and counter to said predetermined direction, said surfaces being provided on said elements and said elements being operative to transport the blanks only during movement in said predetermined direction.

* * * * *